US011719043B2

(12) United States Patent
Powell

(10) Patent No.: US 11,719,043 B2
(45) Date of Patent: Aug. 8, 2023

(54) SYSTEM AND METHOD FOR A RADIAL SUPPORT IN A STATOR HOUSING

(71) Applicant: HALLIBURTON ENERGY SERVICES, INC., Houston, TX (US)

(72) Inventor: Scott W. Powell, Highlands Ranch, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 544 days.

(21) Appl. No.: 16/491,686

(22) PCT Filed: Oct. 24, 2018

(86) PCT No.: PCT/US2018/057374
§ 371 (c)(1),
(2) Date: Sep. 6, 2019

(87) PCT Pub. No.: WO2020/086078
PCT Pub. Date: Apr. 30, 2020

(65) Prior Publication Data

US 2021/0363826 A1 Nov. 25, 2021

(51) Int. Cl.
*E21B 4/02* (2006.01)
*E21B 47/07* (2012.01)

(52) U.S. Cl.
CPC ..... *E21B 4/02* (2013.01); *E21B 47/07* (2020.05)

(58) Field of Classification Search
CPC ..... E21B 4/02; E21B 47/07
See application file for complete search history.

(56) References Cited

U.S. PATENT DOCUMENTS

| | | | | |
|---|---|---|---|---|
| 5,679,894 | A * | 10/1997 | Kruger | E21B 44/005 73/152.01 |
| 5,832,604 | A | 11/1998 | Johnson et al. | |
| 9,334,691 | B2 | 5/2016 | Jarvis et al. | |
| 2009/0169364 | A1 | 7/2009 | Downton | |
| 2010/0038142 | A1* | 2/2010 | Snyder | E21B 4/02 175/57 |
| 2013/0048384 | A1* | 2/2013 | Jarvis | F04C 2/1071 175/57 |
| 2014/0170011 | A1 | 6/2014 | Clouzeau et al. | |
| 2018/0223598 | A1* | 8/2018 | Anderson | F04C 2/1075 |

FOREIGN PATENT DOCUMENTS

EP 1609993 A2 12/2005

OTHER PUBLICATIONS

International Search Report and Written Opinion dated Jul. 18, 2019 for PCT Application No. PCT/US2018/057374, filed Oct. 24, 2018 (12 pages).

* cited by examiner

*Primary Examiner* — Dany E Akakpo
(74) *Attorney, Agent, or Firm* — K&L Gates LLP

(57) ABSTRACT

A system for providing support in a downhole motor, the system includes a stator housing including an end, a stator contour within the stator housing, a rotor including a rotor end and lobes configured to engage with the stator contour to eccentrically rotate the rotor, and a radial support extending from the stator contour toward the end of the stator housing, and positioned radially between the rotor end of the rotor and the stator housing to support the rotor and decrease an amount of eccentric rotation of the rotor.

21 Claims, 9 Drawing Sheets

SYSTEM AND METHOD FOR A RADIAL SUPPORT IN A STATOR HOUSING

BACKGROUND

During a downhole drilling operation, a motor assembly may be utilized to provide power to rotate a drill bit. The motor assembly includes a power section that includes a rotor rotatable within a stator to cooperate as components, more specifically, of a positive displacement type motor designed to provide the power for rotating the drill bit. Further, as the rotor rotates within the stator, the rotor rotates about its own central axis and eccentrically nutates about a central axis of the stator. The power output of the power section positively correlates to the eccentricity of the rotor. Thus, an increase in horse power includes an increase in eccentricity of the rotor, which, when combined with heavy rotor mass, causes high stress loads on the stator. The inside of the stator is lined with an elastomeric stator contour and the eccentric rotation of the rotor eventually leads to fatigue of elastomer due to load cycles caused by the eccentric rotation. The fatigue caused by the large rotating rotor is concentrated on the lower end of the power section.

BRIEF DESCRIPTION OF THE DRAWINGS

Embodiments of the system and method for a radial support are described with reference to the following figures. The same numbers are used throughout the figures to reference like features and components. The features depicted in the figures are not necessarily shown to scale. Certain features of the embodiments may be shown exaggerated in scale or in schematic form, and some details of elements may not be shown in the interest of clarity and conciseness.

DETAILED DESCRIPTION

Figure 1:
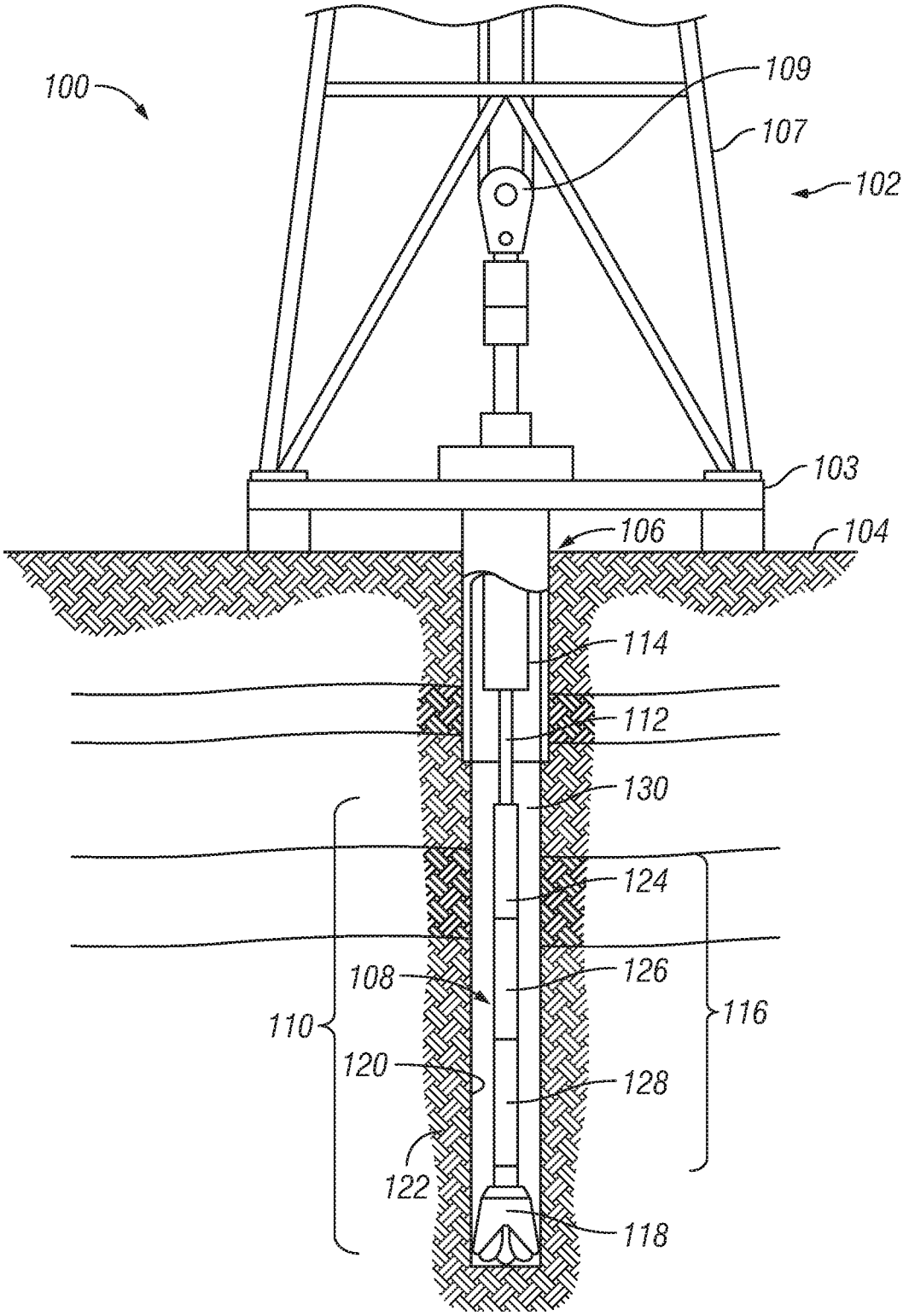
FIG. 1 illustrates a schematic view of a drilling system positioned within a borehole.

FIG. 1 illustrates an example drilling system 100 including a drilling rig 102 located at a surface 104 of a well 106.

The drilling rig 102 includes a drilling platform 103 that is equipped with a derrick 107 to physically support the structure of the drilling rig 102, including a drill string 108 and an elevator 109 that can raise and lower the drill string 108.

The drill string 108 includes a bottom hole assembly ("BHA") 110 located at the lower portion of a drill pipe 112. The BHA 110 includes a drill collar 114, a downhole motor assembly 116, and a drill bit 118. The drill bit 118 operates to create a borehole 120 by penetrating the surface 104 and subsurface formations 122. The downhole motor assembly 116 includes a power section 124 that provides power for rotating the drill bit 118, a transmission section 126 that converts the eccentric rotation (i.e., nutation about a central axis of the stator) of the rotor of the power section 124 to a concentric rotation (i.e., rotation about central axis) before reaching the drill bit 118, and a bearing section 128 that provides protection to the BHA 110 from off bottom and on bottom pressures. The drill collar 114 may be optionally included to add weight and stiffen the BHA 110, to transfer the added weight to the drill bit 118, and in turn, to assist the drill bit 118 in penetrating the surface 104 and subsurface formations 122.

Figure 2:
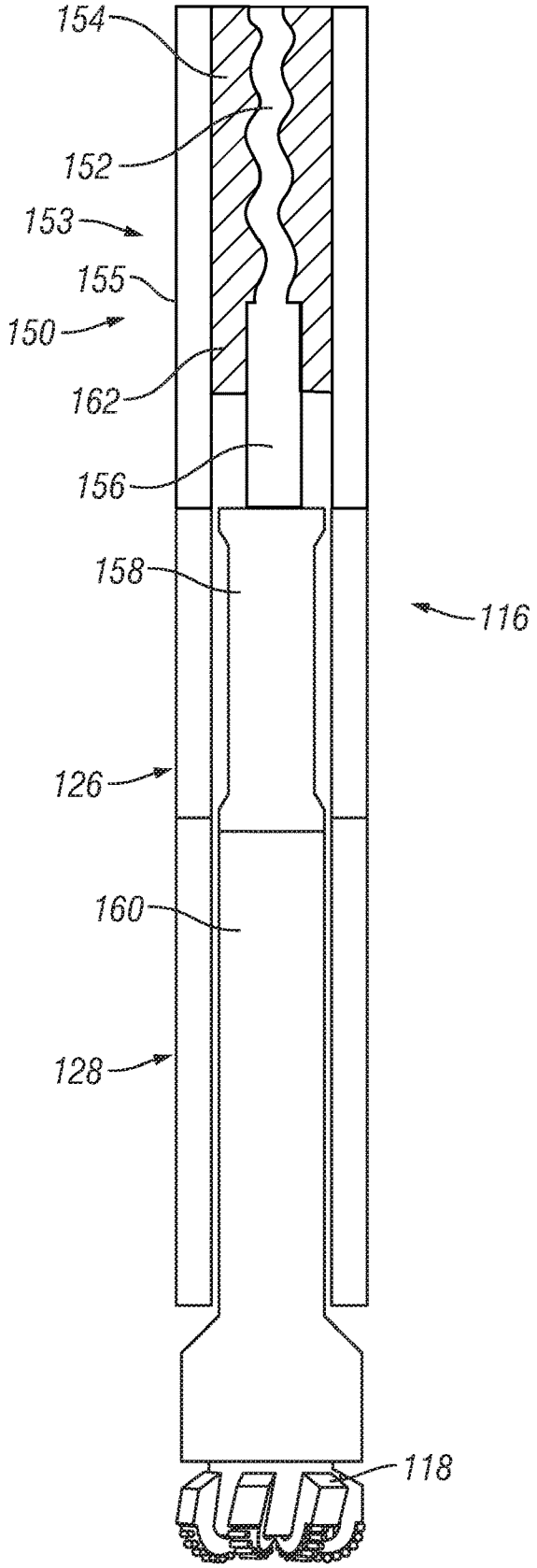
FIG. 2 illustrates a schematic view of a downhole motor assembly with a rotor adapter useable in the drilling system of FIG. 1.

FIG. 2 illustrates the downhole motor assembly 116 of FIG. 1 with the power section 124, the transmission section 126, and the bearing section 128. The power section 124 includes a mud motor 150 that includes a stator 153 having a multi-lobed stator contour 154 and an internal passage within which a multi-lobed rotor 152 is positioned. The multi-lobed stator contour 154 is an elastomeric lining formed on an inner surface of a stator housing 155 of the stator 153 to define an inner surface of the stator 153 that engages with the lobes of the rotor 152.

The mud motor 150 operates according to the Moineau principle whereby when pressurized fluid is forced into the mud motor 150 and through the series of helically shaped channels formed between the stator 153 and the rotor 152, the pressurized fluid acts against the rotor 152 causing nutation and rotation of the rotor 152 within the stator 153. The nutation of the rotor 152 is eccentric rotation as the rotor 152 rotates about a central axis of the rotor 152 and the central axis of the rotor 152 rotates about a central axis of the stator 153. The eccentric rotation of the rotor 152 is then transmitted to an adapter 156 before being transferred to a transmission 158 of the transmission section 126. The transmission 158 receives the eccentric rotation from the rotor 152 and converts the eccentric rotation to a concentric rotation, which is a rotation about only a center axis. The rotation is then transferred to a drive mandrel 160 of the bearing section 128 and finally to the drill bit 118.

The stator housing 155 has an extended length such that, in some embodiments, the rotor 152 cannot couple to the transmission 158 directly. The adapter 156, therefore, is optionally included to provide additional length to connect the rotor 152 and the transmission 158. The stator housing 155 is extended because additional length of the stator housing 155 enables a greater amount of rotational drive force to pass through the rotor 152 to the transmission 158. The additional length and rotational drive force that might otherwise increase the rate of chunking (i.e., the breaking off of portions of a stator contour) or movement of the rotor 152 and transmission 158 in a radial direction is reduced by the inclusion of a radial support 162.

The radial support 162 is integrally formed with the stator contour 154 and extends axially from the downhole end of the stator contour 154. As such, the radial support 162 is included at or near the downhole end of the stator housing 155 and radially between an inner wall of the stator housing 155 and the rotor 152 and adapter 156. The radial bearing 162 provides a physical support between the stator housing 155 and components (i.e., the adapter 156, the rotor 152, and/or the transmission 158) within the stator housing 155 to prevent direct contact between the stator housing 155 and components within the stator housing 155. The radial support 162 also reduces the amount of radial movement of components within the stator housing 155, thereby reducing stresses acting on the stator contour 154 and chunking of the stator contour 154 and increasing the lifespan and reliability of the stator contour 154. Further, by reducing stresses and chunking, the radial support 162 enables the stator contour 154 to withstand higher rotational forces produced by the mud motor 150.

Figure 3A:
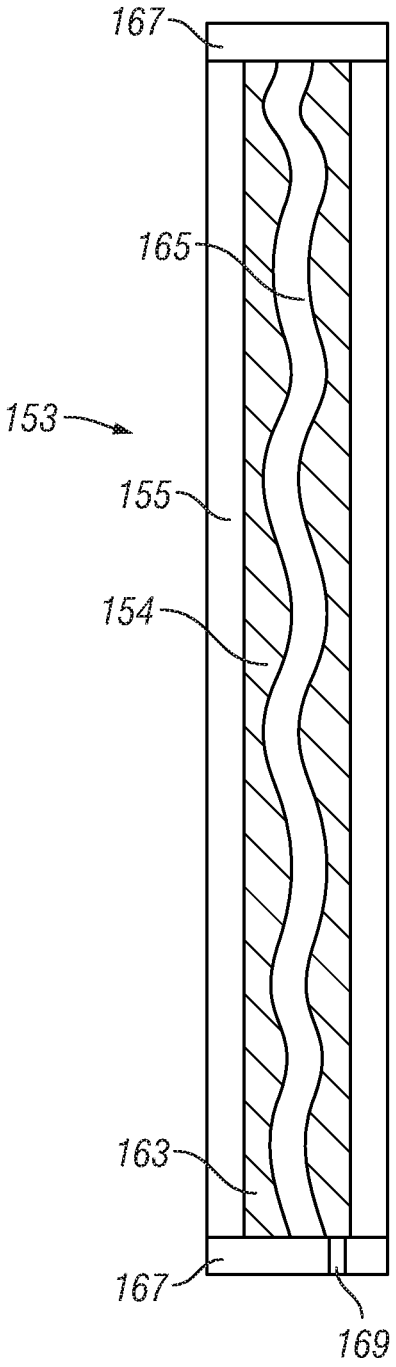
FIG. 3A illustrates a schematic view of an intermediary stage of a manufacturing process for forming a stator contour and radial support.
Figure 3B:
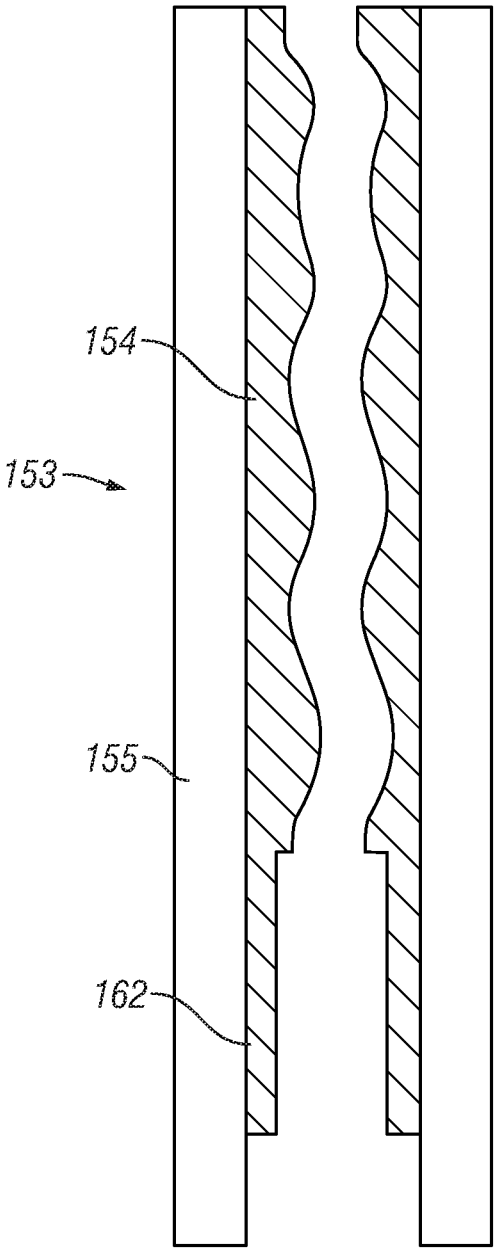
FIG. 3B illustrates a schematic view of a final stage of a manufacturing process for forming a stator contour and radial support.

FIGS. 3A and 3B illustrate stages of a manufacturing process for making the stator contour 154 and radial support 162. FIG. 3A illustrates a molding process in which the stator contour 154 is formed within the stator housing 155 by inserting a stator mold 165 into the stator housing 155. The stator mold 165 includes a surface with lobes that have the inverse shape of the lobes of the stator contour 154 that is formed. After inserting the stator mold 165, end caps 167 are placed on both ends of the stator housing 155 to enclose the stator mold 165 within the stator housing 155. Once the end caps 167 are in place, an elastomer 163 is injected through a port 169 into the cavity formed between the inner surface of the stator housing 155 and the stator mold 165. The elastomer 163 is injected in a fluid state through the port 169 in one of the end caps 167 and fills the cavity to take the shape of the cavity. As such, the elastomer 163 forms around the stator mold 165 into the shape of the stator contour 154. After the elastomer 163 is injected, the elastomer 163 is cured to allow the elastomer 163 to harden into a solid state. Once the elastomer 163 has cured, the end caps 167 and the mold 165 are removed from the stator 153.

With the elastomer 163 cured and the mold 165 removed, excess elastomer is machined out at one end, as shown in FIG. 3B. This is because, in the final product the stator contour 154 does not extend fully along the length from one end cap 167 to the other end cap 167. However, some of the elastomer 163 between the end of the stator contour 154 and an end of the stator 153 is left in place to form the radial support 162. To do so, only a portion of the elastomer 163 is machined away, leaving the radial support 162. Accordingly, this manufacturing process enables the stator contour 154 and the radial support 162 to be formed integrally and during the same process which provides a time and cost efficient way to include the radial support 162 in the stator 153.

Figure 4:
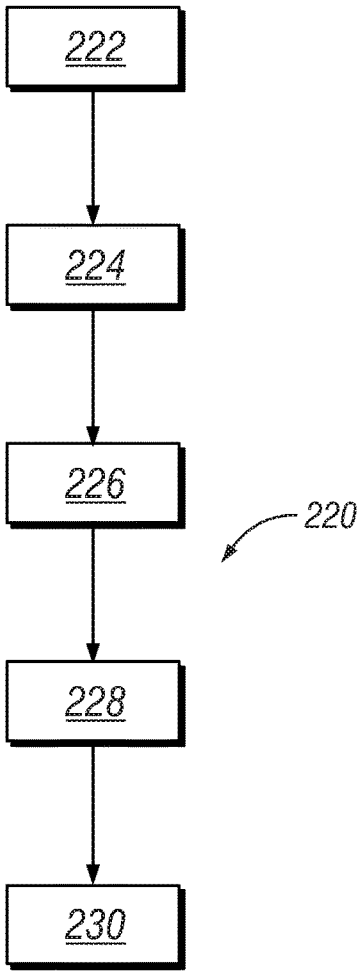
FIG. 4 illustrates a flow chart for a manufacturing process for forming a stator contour and radial support.

FIG. 4 illustrates a flowchart 220 for the manufacture process described in FIGS. 3A and 3B. For example, the radial support may be manufactured in conjunction with the manufacture of the stator contour. A stator mold is inserted into the stator housing to provide the shape for the stator contour that is made in the molding process in step 222. The stator mold included within the stator housing has an inverse shape of the stator contour. Then, end caps are placed on either end of the stator housing to enclose the stator mold within the stator housing in step 224.

To provide material for the stator contour and radial support an elastomer is injected into a cavity between the stator housing and the stator mold to fill the stator housing substantially along an axial length of the stator housing in step 226. After the elastomer is injected, the elastomer is allowed to cure in step 228. Allowing the elastomer to cure may be a passive step in which the curing elastomer is left alone until it is cured. In some embodiments, allowing the elastomer to cure may be an active step in which steps are taken to reduce the curing time of the elastomer. For example, heat may be selectively added or removed from the elastomer and/or airflow may be increased around the elastomer.

Next, excess elastomer is removed from the stator housing in step 230. Once the excess elastomer is removed, the remaining elastomer forms the stator contour and the radial support. Further, because the stator contour and radial support are formed during the same elastomer injection process, the stator contour and radial support are a single piece (i.e., the stator contour and radial support are integral to one another). In one or more embodiments, the length of the radial support may be too long after the curing process. Thus, during removal in step 226, the length of the radial support may be cut. The final length of the radial support may include 8 inches, 10 inches, 12 inches, 14 inches, 16 inches, 18 inches, 20 inches, 22 inches, 24 inches, 26 inches, 28 inches, 30 inches, or any length between 8 and 30 inches. Further, a coating may be applied to the surface of the radial support. The optional coating includes a metallic or ceramic coating that is harder and/or more wear resistant that the material within the core of the radial support, which may reduce the rate of wear on the radial support. In some embodiments, this coating may be applied to a portion of the rotor that contacts the radial support in addition to or instead of being applied to the radial support. After this step, the stator contour and radial support are ready for use within a wellbore.

Figure 5:
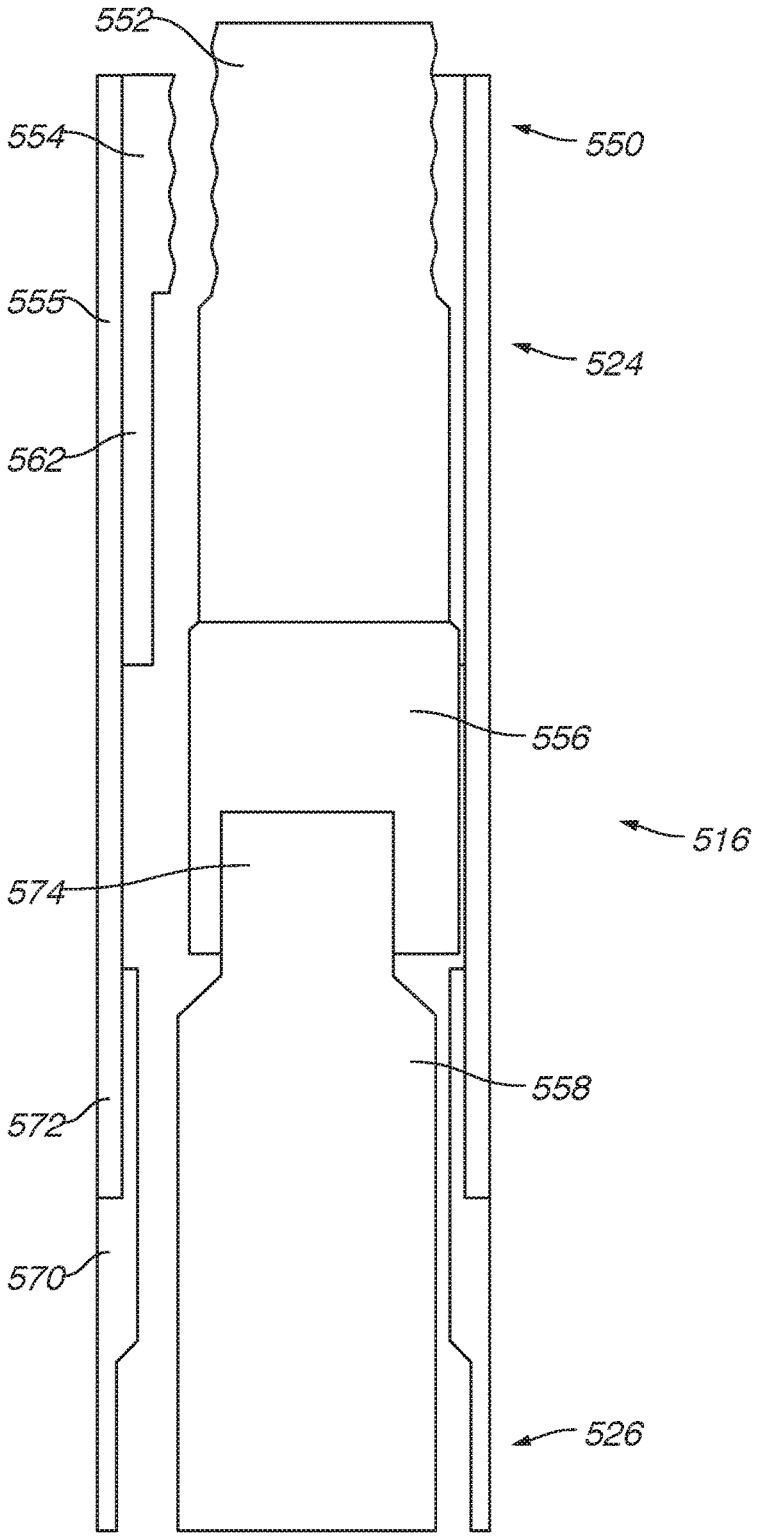
FIG. 5 illustrates a schematic view of an eccentric motion of a rotor supported by a radial support.

FIG. 5 illustrates the connection between the power section 524 and the transmission section 526. As discussed above, the stator contour 554 is positioned between the rotor 552 and the stator housing 555 such that a fluid flow between the stator contour 554 and the rotor 552 causes the rotor 552 to rotate. Further, the adapter 556 is coupled between the rotor 552 and the transmission 558 to transfer rotational forces from the rotor 552 to the transmission 558, which is positioned within a transmission housing 570. The stator housing 555 is coupled to the transmission housing 570 at a coupling 572, which may include a threaded connection or a welded connection.

Due in part to the length of the stator housing 555, the connection between the adapter 556 and the transmission 558 is positioned within the stator housing 555. The greater inner diameter of the stator housing 555 enables a connector 574 of the transmission 558 to be larger and thus have an increased torque capacity. However, utilizing a larger connector 574 also increases stresses and chunking of the downhole end of the stator contour 554. The increased length of the stator housing 555 also increases the area in which components within the stator housing 555 may contact the stator housing 555, causing additional damage to the components.

As discussed above, the radial support 562 is positioned downhole of the stator contour 554 and radially between the stator housing 555 and components positioned within the stator housing 555. As shown in FIG. 5, during rotation of the rotor 552, the rotor 552 and the adapter 556 have moved in a radial direction and into contact with the radial support 562. Engagement with the radial support 562 supports the rotor 552 and/or adapter 556 and prevents contact with the stator housing 555. Further, the radial support 562 reduces the radial movement of the rotor 552 and the adapter 556 as the rotor 552 rotates eccentrically, thereby reducing stress and chunking.

The radial support 562 extends from a downhole end of the stator contour 554 toward the downhole end of the stator housing 555. Although described above as integral, the radial support 562 may also be a separate piece from the stator contour 554. The radial support 562 may also be formed from the same material as the stator contour 554, and the material may include elastomers such as rubber, polymers, or metals. Alternatively, the radial support 562 may be made of a material different than the stator contour 554 and may include any material suitable to support the rotor 552 or other components.

As shown in FIG. 5, the stator contour 554 has a greater thickness than the radial support 562. For example, the radial support 562 may include a thickness of 0.15 inches, 0.20 inches, 0.25 inches, 0.30 inches, 0.35 inches, or any length between 0.15 inches and 0.35 inches. Further, the radial support 562 extends from the stator contour 554 toward the transmission housing 570, but stops short of the coupling 572 between the stator housing 555 and the transmission housing 570, thereby leaving an unsupported section between the radial support 562 and the coupling 572. In some embodiments, the radial support 562 leaves no gap between the downhole end of the stator contour 554 and the coupling 572 or the radial support 562 extends from the coupling 572 and stops short of the stator contour 554, thereby leaving an unsupported section between the radial support 562 and the stator contour 554.

Figure 6A:
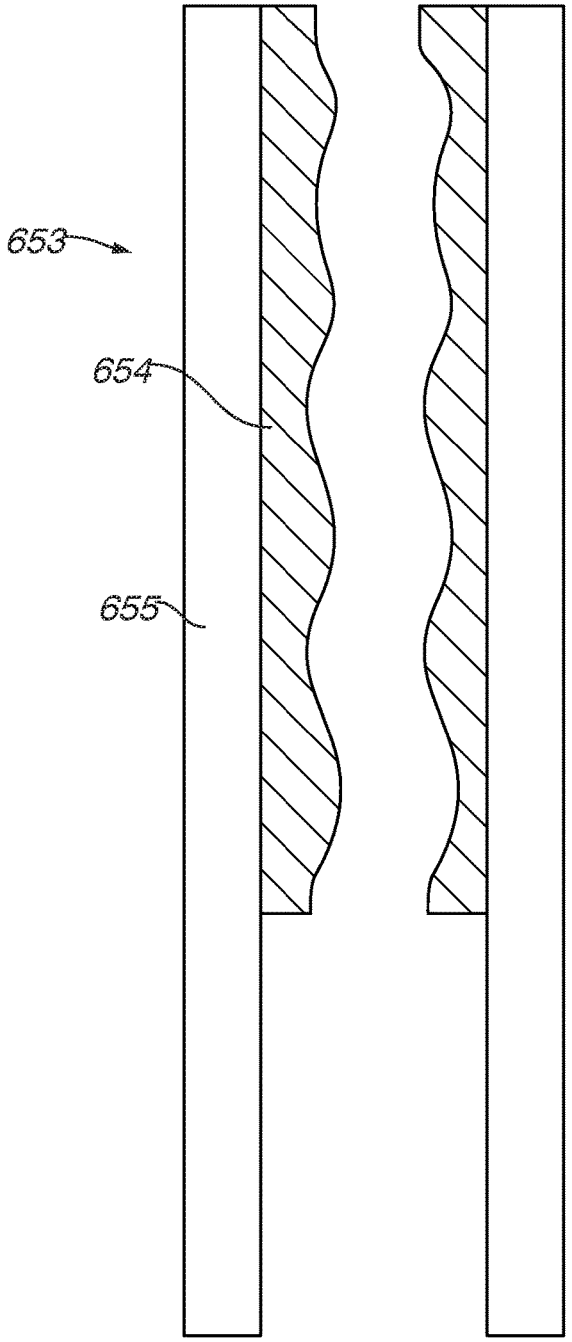
FIG. 6A illustrates a schematic view of an intermediary stage of a servicing process of a radial support.
Figure 6B:
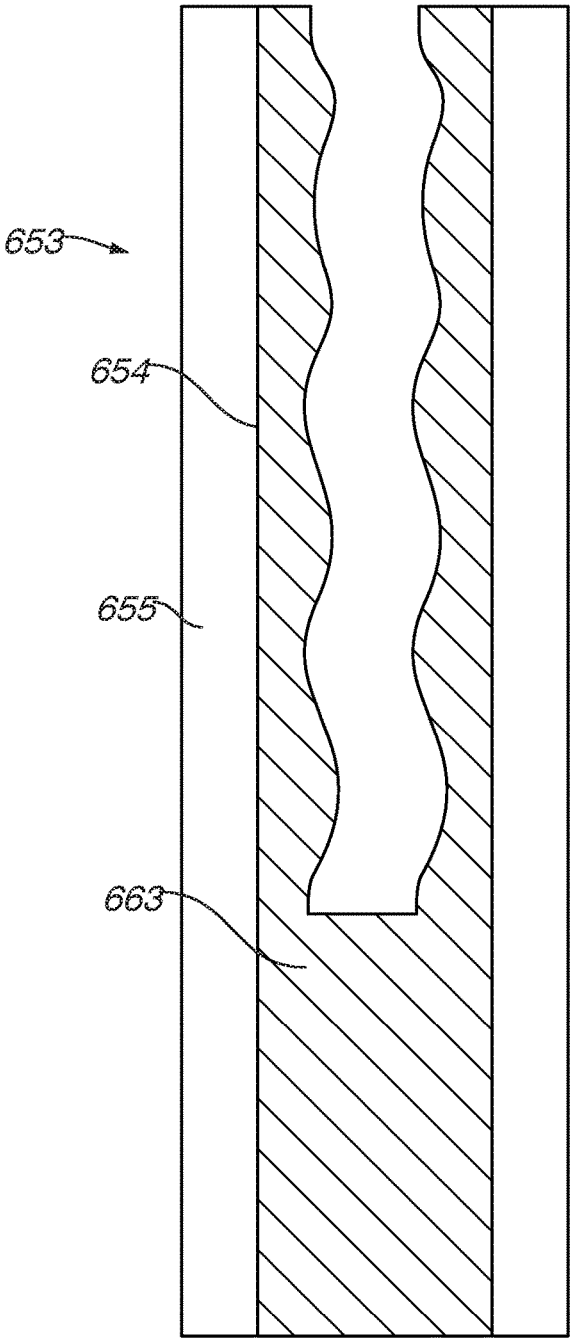
FIG. 6B illustrates a schematic view of an intermediary stage of a servicing process of a radial support.
Figure 6C:
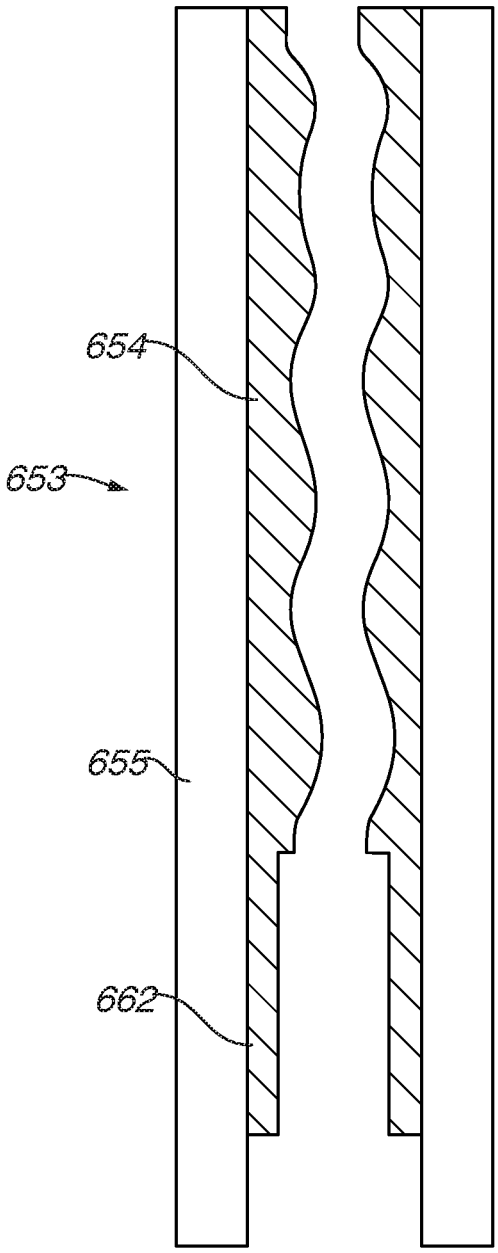
FIG. 6C illustrates a schematic view of a final stage of a servicing process of a radial support.

After a certain amount of use within the wellbore, the radial support 562 wears down and reaches the end of its service life and is replaced. FIGS. 6A through 6C illustrate a servicing process in which the radial support 662 is removed and a new radial support 662 is inserted. In FIG. 6A, the stator 653 is disconnected from other components of the downhole motor assembly 616. Then, the radial support is removed from the stator 653 and the stator housing 655 using a cutting tool, leaving behind the stator contour 654 and the stator housing 655.

After removal of the radial support, additional elastomer 663 is injected into the area in which the radial support is to be located. Optionally, end caps may be utilized to block the elastomer 663 from contacting the inner surface of the stator contour 654. The elastomer 663 may be the same elastomer used to make the stator contour 654 or the elastomer 663 may be different from the elastomer used to make the stator contour 654. Once the elastomer 663 is injected, the elastomer 663 cures and bonds to the stator housing 655. After the elastomer 663 cures, excess elastomer from the elastomer 663 is removed, such as by a cutting tool, to leave behind the radial support 662 as illustrated in FIG. 6C. Now the new radial support 662 is installed and the stator 653 is ready to be put back into use.

Figure 7:
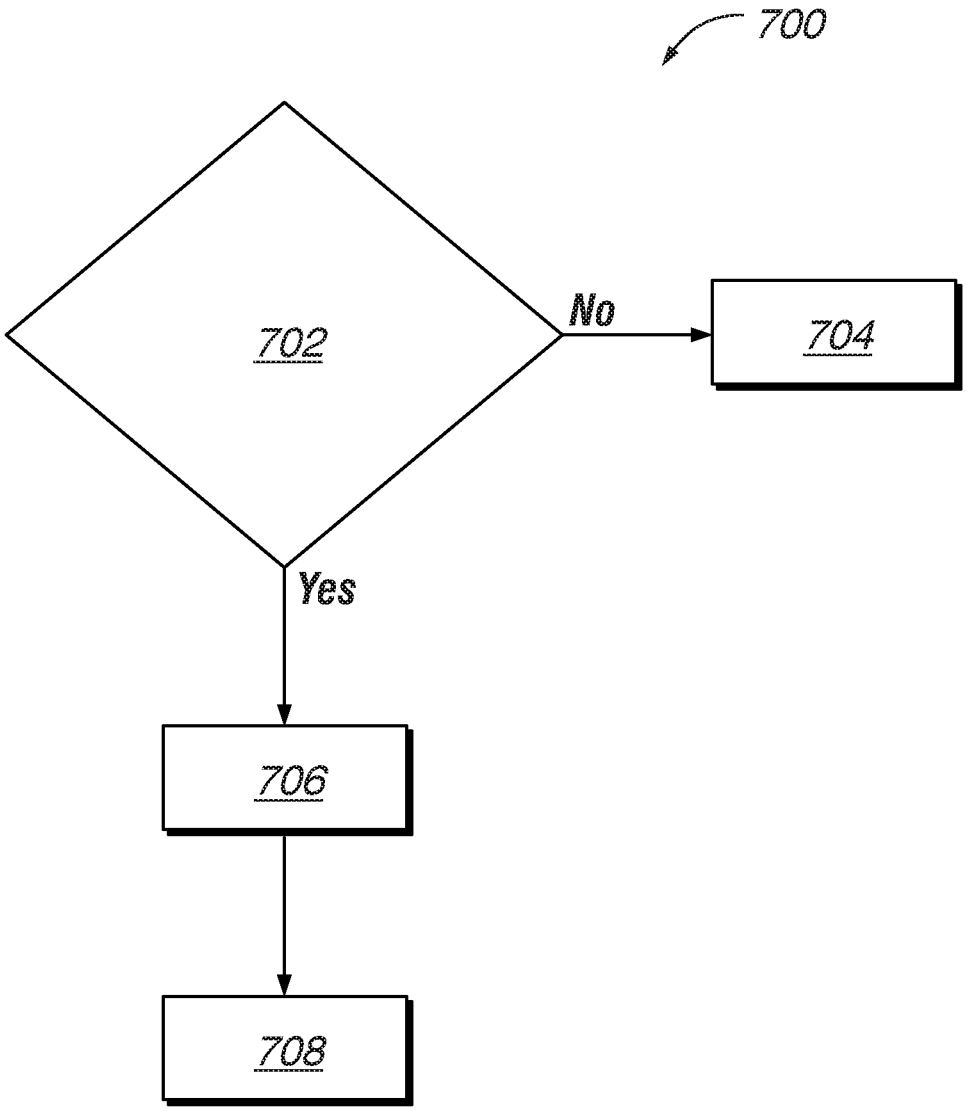
FIG. 7 illustrates a flow chart for a servicing process of a radial support.

FIG. 7 illustrates a flowchart 700 for the servicing process described in FIGS. 6A through 6C. After being used within a wellbore, the life cycle of the radial support may be checked during a servicing and/or maintenance procedure in step 702. For example, the radial support may be inspected for signs of wear indicating replacement, or the radial support may be replaced at predetermined intervals. If it is determined that the radial support is not at an end of its useful life cycle, the radial support may be left in place in step 704.

Conversely, if is determined that the radial support is at an end of its useful life cycle, the radial support is removed from the stator housing while the stator contour is left intact in step 706. For example, the radial support may be cut and/or machined out of the stator housing while leaving the stator contour in the stator housing. After removal of the radial support, a new radial support is inserted into the stator housing in step 708. In some embodiments, the new radial support may be a piece separate from the stator contour that fits adjacent to the stator contour. In some embodiments, the new radial support is injected into the stator housing and allowed to cure. Accordingly, the radial support may be a separate piece from the stator contour.

Figure 8:
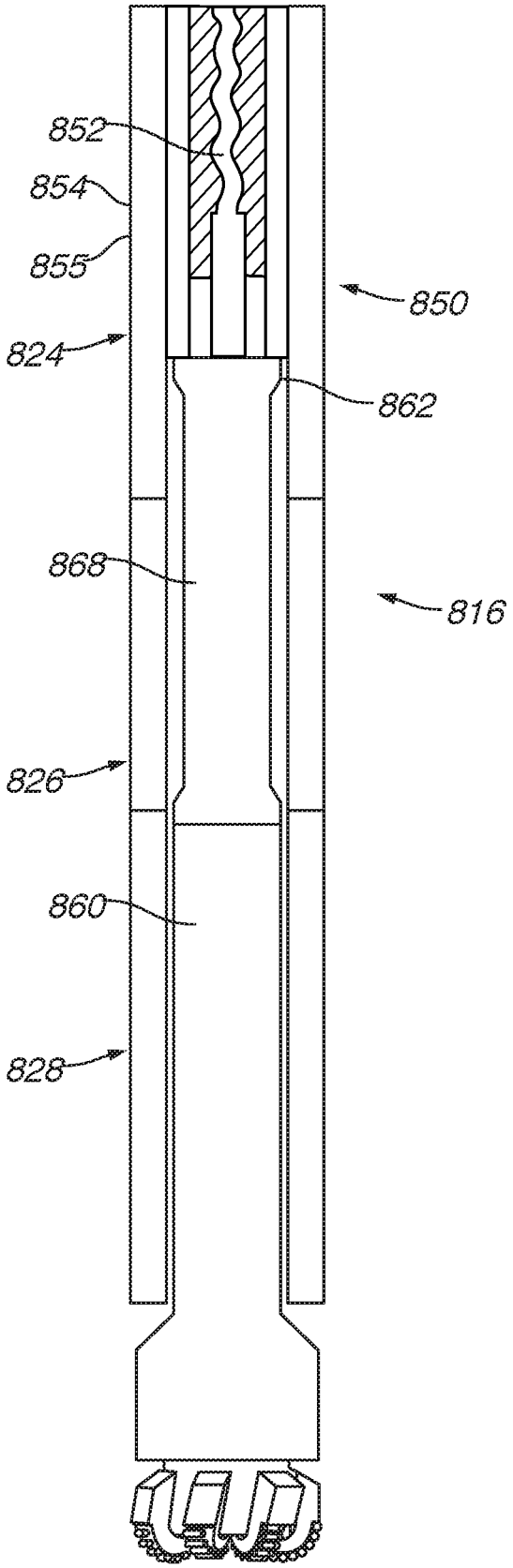
FIG. 8 illustrates a schematic view of a second embodiment of a downhole motor assembly with an extended transmission.

FIG. 8 illustrates a side partial cross section view of another embodiment of a downhole motor assembly 816 that includes an extended transmission 868 instead of the adapter 156 shown in FIG. 2. The extended transmission 868 has an increased length to match the length of the stator housing 855. As such, in FIG. 8, the rotor 852 couples directly to the extended transmission 868. Further, the stator contour 854 and radial support 862 are formed in the same manner as the embodiment illustrated in FIG. 2.

Further, in FIG. 8, the radial support 862 is positioned downhole of the stator contour 854 and radially between the stator housing 855 and components positioned within the stator housing 855, such as the rotor 852 and/or the extended transmission 868. The radial support 862 provides additional support between the stator housing 855 and components positioned within the stator housing 855 and acts as a physical barrier between the stator housing 855 and components within the stator housing to prevent direct contact between the stator housing 855 and components within the stator housing 855. The radial support 862 also reduces the amount of radial movement of the rotor 852 and the extended transmission 868 within the stator housing 855, thereby reducing stresses and chunking and increase the lifespan and reliability of the stator contour 854 within the stator housing 855. Further, by reducing stresses acting on the stator contour 854 and chunking of the stator contour 854, the radial support 862 may enable the stator contour 854 within the stator housing 855 to withstand higher rotational forces produced by the mud motor 850.

Figure 9:
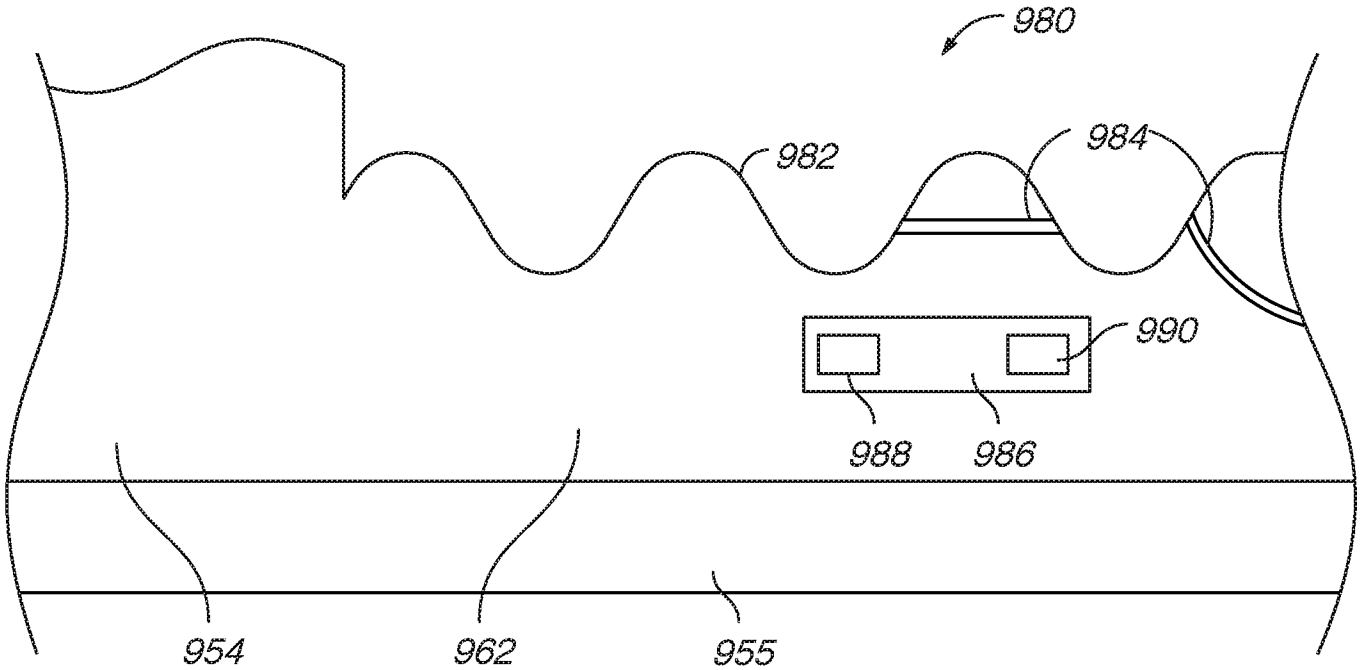
FIG. 9 illustrates a schematic view of third embodiment of a downhole motor assembly including a radial support with a sensor package.

FIG. 9 illustrates a schematic view of a portion of a radial support 962 having a cooling system 980. In a downhole environment, in which the radial support 962 is used, temperatures may be very high, for example, higher than 140° C. The high temperatures may detrimentally change the physical properties of the elastomer material that form the radial bearing 962. Providing cooling to the radial bearing 962 may increase the durability of the radial bearing 962. To reduce the temperature of the radial support 962, the cooling system 980 includes ribs 982 shaped to cause and/or increase a radial flow of fluid flowing through the stator housing 955 and along a surface of the radial support 962. The radial flow of fluid introduces and/or increases the amount of convective heat transfer, thereby increasing the overall rate of heat transfer between the radial support 962 and the fluid. The ribs are separate from the stator contour and may be formed by a mold or by machining using a similar process as described in FIG. 4. The cooling system 980 may include vents 984 such as holes to introduce passages that enable a fluid to flow through at least a portion of the radial support 962.

Further, monitoring the physical environment of the area proximate to the radial support 962 may provide measurements that can improve monitoring of the physical state of the radial support 962, or future designs of the radial bearing 962. As such, the radial support 962 may include the sensor package 986 to detect physical properties, such as temperature, proximate to the radial support 962. For example, the sensor package 986 may include a physical property sensor 988, such as a temperature sensor, to measure a physical property proximate to the radial support 962. For example, the sensor 988 may be positioned to measure a property on an edge of the radial support 962 or within the radial support 962. The sensor package 986 may also include a data storage device 990 for storing data related to physical properties measured by the sensor 986, such as a log of the measured physical property. The data storage device may include any device for storing data, such as non-persistent storage (e.g., volatile memory, such as random access memory, cache memory) or persistent storage (e.g., a hard disk, an optical drive such as a compact disk drive or digital versatile disk drive, or a flash memory).

The present disclosure may be used to provide support in a stator housing by including a radial support. The radial support may be positioned downhole of a stator contour and between the stator housing and components contained within the stator housing, such as a rotor, an adapter, and/or a transmission. The radial support may prevent contact between the stator housing and components contained within the stator housing. Further, the radial support may decrease the radial range of motion of components contained within the stator housing, thereby reducing stresses acting on the stator contour and chunking of the stator contour and increasing the durability and longevity of the stator contour. Further, the radial support may be replaceable.

Further examples may include:

Example 1 is a system for providing support in a downhole motor. The system includes a stator housing including an end, a stator contour within the stator housing, a rotor including a rotor end and lobes configured to engage with the stator contour to eccentrically rotate the rotor, and a radial support extending from the stator contour toward the end of the stator housing, and positioned radially between a rotor end of the rotor and the stator housing to support the rotor and decrease an amount of eccentric rotation of the rotor.

In Example 2, the subject matter of Example 1 can further include wherein the radial support is integral to the stator contour.

In Example 3, the subject matter of Example 1 can further include wherein the radial support also supports a connection of the rotor.

In Example 4, the subject matter of Examples 1-3 can further include wherein the radial support and the stator contour comprise the same material.

In Example 5, the subject matter of Examples 1-4 can further include wherein the radial support comprises ribs shaped to cause a radial flow of a fluid flowing through the stator housing to increase a rate of heat transfer between the radial support and the fluid.

In Example 6, the subject matter of Examples 1-5 can further include wherein the radial support includes a sensor package positioned within the radial support, and the sensor package includes a sensor configured to measure a physical property.

In Example 7, the subject matter of Examples 1-6 can further include wherein the sensor package includes a data storage device to store a log of the sensed physical property.

In Example 8, the subject matter of Examples 1-7 can further include wherein the sensor is a temperature sensor and the physical property is temperature.

In Example 9, the subject matter of Examples 1-8 can further include wherein the radial support comprises a core comprising a first material and a coating comprising a second material that is more resistant to wear than the first material.

In Example 10, the subject matter of Examples 1-9 can further include a transmission and a rotor adapter coupled between the rotor end and the transmission.

In Example 11, the subject matter of Examples 1-9 can further include wherein a thickness of the stator contour is greater than a thickness of the radial support.

Example 12 is a method for manufacturing a radial support within a stator housing. The method includes injecting a material into a stator housing, curing the injected material, and removing excess material from the stator housing, wherein the remaining material forms a single piece comprising a stator contour and a radial support that extends axially from the stator contour within the stator housing.

In Example 13, the subject matter of Example 12 can further include supporting a rotor that extends through an internal passage of the stator housing with the radial support.

In Example 14, the subject matter of Examples 12-13 can further include supporting the rotor with the radial support further toward a downhole end of the stator housing than the rotor.

In Example 15, the subject matter of Examples 12-14 can further include causing a radial flow of a fluid flowing through the stator housing via ribs positioned on the radial support to increase a rate of heat transfer between the radial support and the fluid.

Example 16, the subject matter of Examples 12-15 can further include measuring a physical property of the radial support with a sensor package within the radial support.

In Example 17, the subject matter of Examples 12-16 can further include storing a log of the physical property via a data storage device of the sensor package.

In Example 18, the subject matter of Examples 12-17 can further include wherein removing excess material forms the stator contour with a thickness greater than a thickness of the radial support.

In Example 19, the subject matter of Examples 12-18 can further include coating the radial support in a second material that is more resistant to wear than the injected material.

In Example 20, the subject matter of Examples 12-19 can further include wherein the radial support extends between eight and twenty inches from the stator contour.

One or more specific embodiments of the system and method for a radial support in a stator housing have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A system for providing support in a downhole motor connected to a transmission, the system comprising:

a stator housing comprising an end;

a stator contour within the stator housing and comprising a first compressibility and lobes comprising a first surface profile;

a rotor comprising a rotor end and lobes configured to engage with the stator contour to eccentrically rotate the rotor within a first radial range of motion;

an adapter coupled to the rotor to connect the rotor to the transmission; and a radial support comprising an elastomer having a second compressibility and a surface extending from the stator contour toward the end of the stator housing, the entire surface comprising a consistent second surface profile different than the first surface profile, the radial support positioned radially relative to the rotor end of the rotor and the adapter such that at least one of the rotor or the adapter physically engages the radial support during the eccentric rotation of the rotor, and sized to support the rotor and decrease an amount of eccentric rotation of the rotor to a second radial range of motion that is less than the first radial range of motion, wherein the second compressibility is the same or greater than the first compressibility.

2. The system of claim 1, wherein the radial support is integral to the stator contour.

3. The system of claim 1, wherein the radial support also supports a connection of the rotor.

4. The system of claim 1, wherein the radial support and the stator contour comprise the same material.

5. The system of claim 1, wherein the surface of the radial support comprises ribs shaped to cause a radial flow of a fluid flowing through the stator housing to increase a rate of heat transfer between the radial support and the fluid.

6. The system of claim 1, wherein the radial support comprises a sensor package positioned within the radial support, and the sensor package comprises a sensor configured to measure a physical property.

7. The system of claim 6, wherein the sensor package includes a data storage device to store a log of the sensed physical property.

8. The system of claim 6, wherein the sensor is a temperature sensor and the physical property is temperature.

9. The system of claim 1, wherein the radial support comprises a core comprising a first material and a coating comprising a second material that is more resistant to wear than the first material.

10. The system of claim 1, wherein a thickness of the stator contour is greater than a thickness of the radial support.

11. The system of claim 1, wherein the surface of the radial support comprises a flat surface extending axially from the stator contour.

12. A method of drilling a borehole comprising:

operating a downhole motor connected to a transmission to rotate a drill bit wherein the downhole motor comprises:

a stator housing comprising an end and a stator contour within the stator housing, the stator contour comprising a first compressibility and lobes comprising a first surface profile;

a rotor comprising a rotor end and lobes configured to engage with the stator contour to eccentrically rotate the rotor within a first radial range of motion;

an adapter coupled to the rotor to connect the rotor to the transmission; and a radial support comprising an elastomer having a second compressibility and a surface extending from the stator contour toward the end of the stator housing, the entire surface comprising a consistent second surface profile different than the first surface profile, the radial support positioned radially relative to the rotor end of the rotor and the adapter such that at least one of the rotor or the adapter physically engages the radial support during the eccentric rotation of the rotor, wherein the second compressibility is the same or greater than the first compressibility;

supporting the rotor with the radial support to decrease an amount of eccentric rotation of the rotor to a second radial range of motion that is less than the first radial range of motion; and drilling the borehole with the rotation of the drill bit.

13. The method of claim 12, wherein the radial support is integral with the stator contour.

14. The method of claim 12, wherein supporting the rotor with the radial support further comprises supporting the rotor further toward a downhole end of the stator housing than the rotor.

15. The method of claim 12, further comprising flowing a fluid through the stator housing via ribs positioned on the radial support to increase a rate of heat transfer between the radial support and the fluid.

16. The method of claim 12, further comprising measuring a physical property of the radial support with a sensor package within the radial support.

17. The method of claim 16, wherein the sensor package comprises a temperature sensor and the physical property is temperature.

18. The method of claim 16, further comprising storing a log of the physical property in a data storage device of the sensor package.

19. The method of claim 12, wherein the thickness of the stator contour is greater than the thickness of the radial support.

20. The method of claim 12, wherein the radial support is coated in a material that is more resistant to wear than the material of the stator contour and radial support.

21. The method of claim 12, wherein the surface of the radial support comprises a flat surface extending axially from the stator contour.

* * * * *